US006375435B2

(12) United States Patent
Sundberg et al.

(10) Patent No.: US 6,375,435 B2
(45) Date of Patent: Apr. 23, 2002

(54) STATIC CAM SEAL FOR VARIABLE DISPLACEMENT VANE PUMP

(75) Inventors: Jack G. Sundberg, Meriden; Kenneth W. Devins, West Hartford; Raymond D. Zagranski, Somers; William H. Dalton, Amston, all of CT (US)

(73) Assignee: Coltec Industries Inc, Charlotte, NC (US)

( * ) Notice: Subject to any disclaimer, the term of this patent is extended or adjusted under 35 U.S.C. 154(b) by 0 days.

(21) Appl. No.: 09/741,524

(22) Filed: Dec. 20, 2000

Related U.S. Application Data

(63) Continuation-in-part of application No. 09/506,465, filed on Feb. 17, 2000, now abandoned.
(60) Provisional application No. 60/171,382, filed on Dec. 22, 1999, and provisional application No. 60/120,451, filed on Feb. 17, 1999.

(51) Int. Cl.[7] ..... F04B 49/00
(52) U.S. Cl. ..... 417/220; 418/30; 418/31
(58) Field of Search ..... 417/220, 219; 418/30, 31

(56) References Cited

U.S. PATENT DOCUMENTS

| | | | | | |
|---|---|---|---|---|---|
| 2,433,484 | A | * | 12/1947 | Roth | 418/30 |
| 4,097,204 | A | * | 6/1978 | Palmer | 418/30 |
| 4,354,809 | A | | 10/1982 | Sundberg | |
| 4,673,341 | A | * | 6/1987 | Bristow | 418/30 |
| 4,679,995 | A | * | 7/1987 | Bristow | 418/30 |
| 4,923,377 | A | | 5/1990 | Cavalleri | |
| 5,545,014 | A | | 8/1996 | Sundberg et al. | |
| 5,545,018 | A | | 8/1996 | Sundberg | |
| 5,738,500 | A | | 4/1998 | Sundberg | |
| 5,752,815 | A | | 5/1998 | Müller | 418/26 |
| 5,863,189 | A | * | 1/1999 | Sundberg et al. | 418/16 |

FOREIGN PATENT DOCUMENTS

| | | | |
|---|---|---|---|
| DE | 40 11 671 A | 10/1991 | 418/26 |
| EP | 0 210 786 | 2/1987 | |
| JP | 59157890 | 8/1984 | |

* cited by examiner

*Primary Examiner*—Cheryl J. Tyler
(74) *Attorney, Agent, or Firm*—Cummings & Lockwood

(57) ABSTRACT

A variable displacement vane pump includes a pump housing having a cylindrical interior chamber, a cylindrical rotor member mounted for rotational movement within the interior chamber of the pump housing, a cam member mounted for pivotal movement within the interior chamber of the pump housing about a fulcrum aligned with the vertical centerline of the interior chamber, the cam member defining a cam body having a circular bore extending therethrough for receiving the rotor member, the cam body having lateral sealing lands formed thereon, the sealing lands having arcuate sealing surfaces defining segments of a cam arc through which the cam member pivots, and static cam seals supported within the interior chamber of the pump housing and oriented on each end of a chord of the cam arc, each cam seal biased into a continuous contact position with an adjacent sealing surface of the cam member.

19 Claims, 5 Drawing Sheets

Fig. 1
(Prior Art)
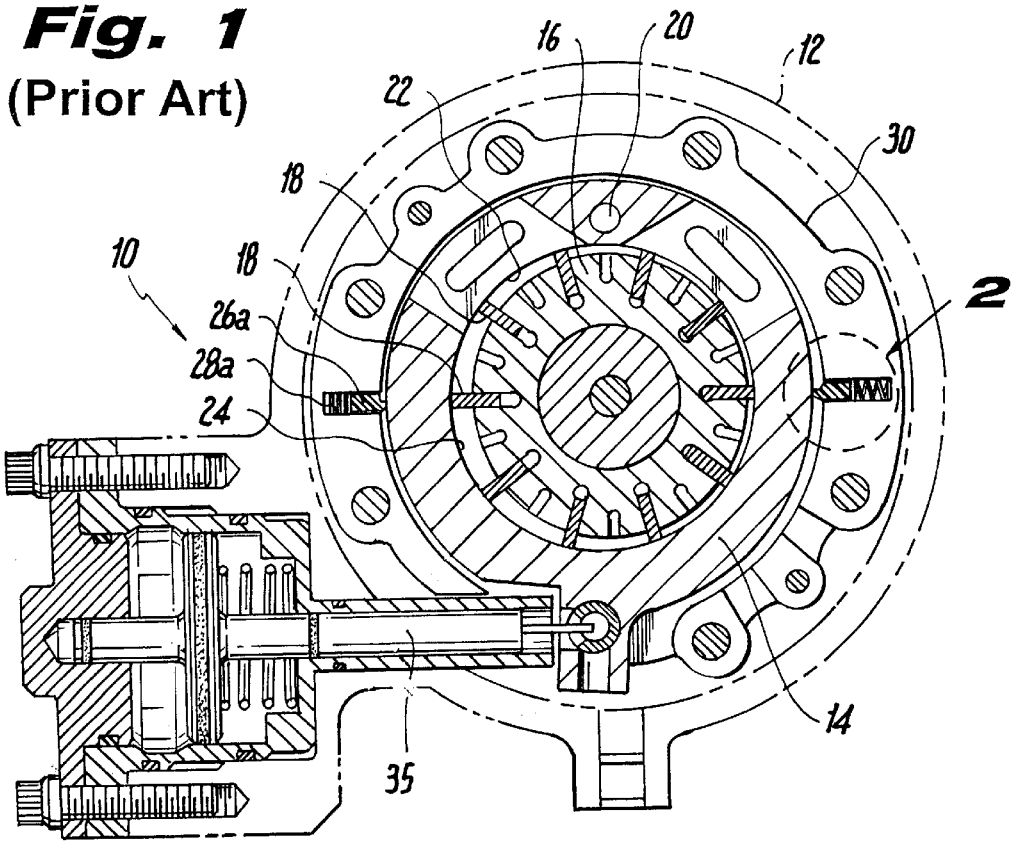
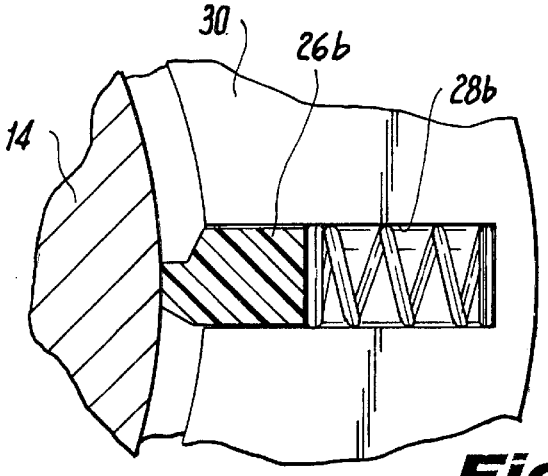
Fig. 2
(Prior Art)

STATIC CAM SEAL FOR VARIABLE DISPLACEMENT VANE PUMP

CROSS-REFERENCE TO RELATED APPLICATIONS

The subject application claims priority to U.S. Provisional Patent Application Ser. No. 60/171,382 filed Dec. 22, 1999, and is a continuation-in-part of U.S. application Serial No, 09/506,465 filed Feb. 17, 2000, now abandoned, which claims priority to U.S. Provisional Patent Application 60/120,451 filed Feb. 17, 1999.

BACKGROUND OF THE INVENTION

1. Field of the Invention

The subject invention relates to fuel metering systems, and more particularly, to an improved cam seal for a variable displacement fluid pressure vane pump for use with gas turbines.

2. Background of the Related Art

For many years, main engine fuel pumps have been fixed displacement gear pumps. Although such pumps are durable they are also inefficient. Fixed displacement vane pumps were developed in order to overcome certain deficiencies of gear pumps. An example of such a pump is disclosed in U.S. Pat. No. 4,354,809, the disclosure of which is herein incorporated by reference in its entirety.

Vane pumps include a rotor element that has slots for supporting radially movable vane elements. The rotor element is mounted within a cam member defining a cam surface. The cam surface has a fluid inlet port through which fluid is delivered to the low pressure inlet areas of the rotor surface. The fluid is subsequently compressed and discharged from the high pressure outlet areas of the rotor surface as pressurized fluid.

Variable displacement vane pumps are known, as disclosed for example in U.S. Pat. Nos. 5,545,014 and 5,545,018, the disclosures of which are herein incorporated by reference in their entireties. These pumps contain a swing cam element which pivots relative to the rotor element, so as to change the relative volumes of the inlet and outlet discharge areas and thereby vary the displacement capacity of the pump.

Variable displacement vane pumps often have leakage problems in the high pressure discharge arc area. Spring biased cam seal elements that frictionally engage the faces of the swing cam in the discharge arc area have been designed to overcome these problems, as described for example in U.S. Pat. No. 5,783,500, the disclosure of which is incorporated by reference herein in its entirety.

In the past, seal elements associated with the swing cam have been aligned with the horizontal centerline of the pump. Thus, the cam seals follow the cam stroke. If one or both of the cam seals should happen to bind up due to contamination and be unable to follow the cam, a major leak path would result. In the worst case, the sealed high pressure cavity on the outer diameter of the cam will become inlet pressure, and internal leakage will increase across the fixed clearance between the cam and the sideplates. It is readily apparent that a solution to this problem is necessary.

SUMMARY OF THE INVENTION

The subject invention is directed to an improved cam seal arrangement for a variable displacement vane pump which solves the problems associated with cam seals on prior art vane pumps. In particular, the subject invention is directed to a variable displacement vane pump in which the cam seals are located along the arc defined by the cam as it swings about its pivot point relative to the rotor member. Consequently, the seals function as static seals, and will not bind up in their slots. This will minimize cam seal leakage if a seal fails to follow the cam stroke.

In accordance with a preferred embodiment of the subject invention the variable displacement vane pump disclosed herein includes a pump housing having a cylindrical interior chamber defining a central axis through which a vertical centerline and a horizontal centerline extends. A cylindrical rotor member is mounted for rotational movement within the interior chamber of the pump housing about an axis aligned with the central axis of the interior chamber. The rotor member has a central vane section including a plurality of circumferentially spaced apart radial vane slots formed therein. Each vane slot supports a corresponding vane element which is mounted for radial movement therein, and each vane element has an outer tip surface.

A cam member is mounted for pivotal movement within the interior chamber of the pump housing about a fulcrum aligned with the vertical centerline of the interior chamber. The cam member defines a cam body having a circular bore extending therethrough for receiving the rotor member. The circular bore forms a cam chamber defining a smooth cam surface making continuous contact with the outer tip surfaces of the vane elements during the rotation of the rotor member. The cam body has opposed lateral sealing lands formed thereon which have arcuate sealing surfaces that define segments of a cam arc through which the cam member pivots or swings relative to the rotor member.

The variable displacement vane pump of the subject invention further includes lateral cam seals supported within the interior chamber of the pump housing for sealingly isolating the high pressure zone of the pump from the relatively lower inlet pressure of the pump. Each cam seal is biased into a continuous contact position with an adjacent sealing surface of the cam member. The cam seals are oriented on each end of a chord of the cam arc. The chord of the cam arc extends parallel to and is located below the horizontal centerline of the interior chamber. Consequently, the cam seals act as static seals which are less likely to bind up during operation and cause internal leakage across the fixed clearance between the cam member and the sideplates.

Preferably, the variable displacement vane pump of the subject invention includes opposed sideplates disposed within the interior chamber of the pump housing. The sideplates support the rotor member and cam member therebetween. An axial spacer having an axial thickness slightly greater than an axial thickness of the cam member is preferably positioned between the opposed sideplates for reducing or eliminating friction between the sideplates and the cam member. The static cam seals are supported by the axial spacer and are oriented on each end of a chord of the cam arc through which the cam member swings so as to prevent fuel leakage between the high and low pressure zones formed in the area defined between the sideplates.

These and other unique features of the subject invention will become more readily apparent from the following description of the drawings taken in conjunction with the description of the preferred embodiment.

BRIEF DESCRIPTION OF THE DRAWINGS

So that those having ordinary skill in the art to which the subject invention appertains will more readily understand how to construct the variable displacement vane pump of the subject invention, reference may be had to the drawings wherein:

FIG. 1 is a cross-sectional view of a prior art variable displacement vane pump, taken along a plane extending transverse to the longitudinal axis of the pump, wherein the cam seals are located along the horizontal center line of the pump housing;

FIG. 2 is an enlarged localized view of a lateral cam seal of the variable displacement vane pump illustrated in FIG. 1;

DETAILED DESCRIPTION OF THE PREFERRED EMBODIMENTS

Figure 3:
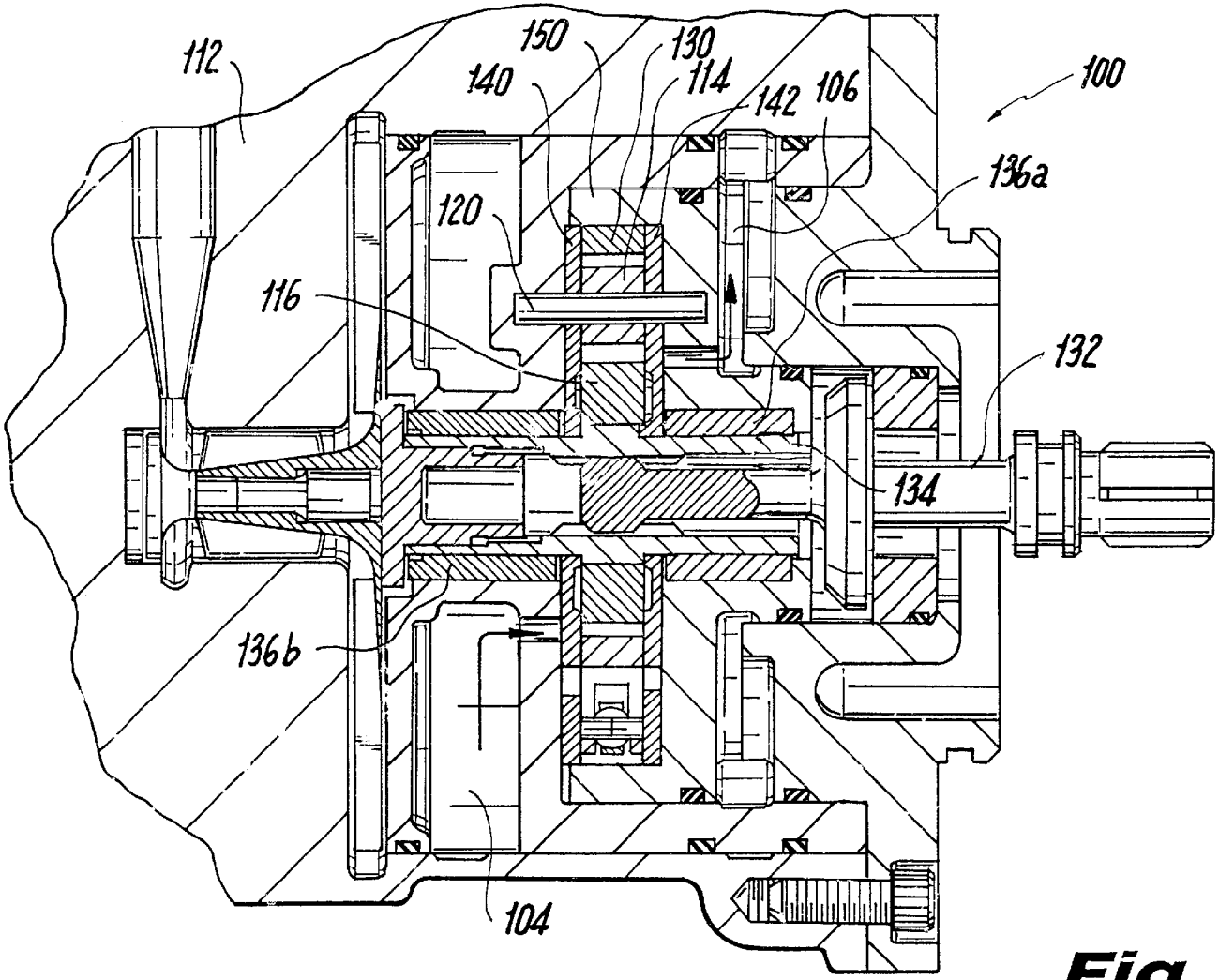
FIG. 3 is a cross-sectional view of a variable displacement vane pump constructed in accordance with a preferred embodiment of the subject invention taken along a plane extending parallel to the longitudinal axis of the pump, and illustrating the direction of fuel flow through the pump housing.

Referring now to the drawings wherein like reference numerals identify similar structural elements of the disclosed apparatus, there is illustrated in FIG. 1 a prior art variable displacement vane pump designated generally by reference numeral 10. Vane pump 10, which is substantially similar to the vane pump disclosed in commonly assigned U.S. Pat. No. 5,545,014, includes a pump housing 12 defining an interior chamber which supports a cam member 14 and a rotor member 16. Rotor member 16 includes a plurality of radially extending slots, each for supporting a corresponding vane element 18. Cam member 14 is mounted for pivotal movement about pivot pin 20 supported in housing 12 and defines a circular bore 22 forming a cam chamber. The cam chamber defines a cam surface 24 making continuous contact with the outer tip surfaces of the vane elements 18.

Spring biased cam seals 26*a* and 26*b* are supported within corresponding slots 28*a* and 28*b* formed in axial spacer member 30, as best seen in FIG. 2. Axial spacer 30 is supported within housing 12 by a plurality of threaded fasteners disposed about the periphery thereof. Cam seals 26*a* and 26*b* are aligned with the horizontal centerline of the rotor member 16 and are configured in such a manner so that the tips of the cam seals remain in contact with the radially outer surface of the cam member 14 regardless of the position of the cam member 14. The cam seals 26*a* and 26*b* are positioned so as to divide the cavity formed between the axial spacer 30 and the cam member 14 into a high pressure zone and a low pressure zone, and prevent circumferential fuel flow therebetween so as to improve pump efficiency.

In operation, as the cam member 14 pivots about pin 20 relative to rotor member 16 in response to actuation of piston 35 to vary the displacement of the pump 10, the cam seals 26*a* and 26*b* reciprocate within slots 28*a* and 28*b*, as they follow the cam stroke. If one or both of the horizontally disposed cam seal 26*a* and 26*b* should happen to bind up in its slot and be unable to follow the cam member, a major leak path would result, decreasing pump efficiency.

Figure 4:
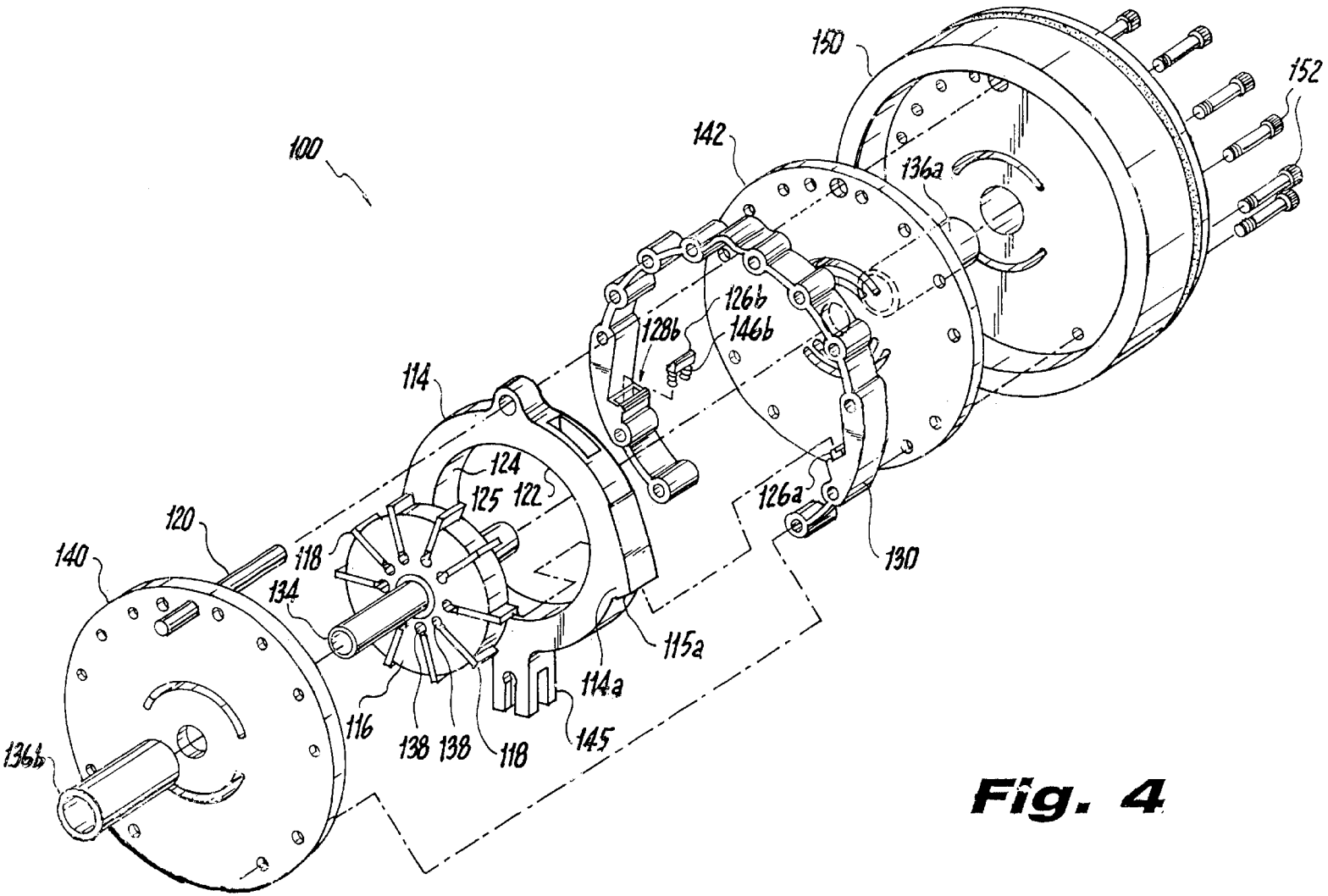
FIG. 4 is a an exploded perspective view of the variable displacement vane pump of FIG. 4 with parts separated for ease of illustration.

Referring now to FIGS. 3 and 4, there is disclosed a variable displacement vane pump constructed in accordance with a preferred embodiment of the subject invention and designated generally by reference numeral 100. Vane pump 100 includes a pump housing 112 defining an interior pumping chamber having a central longitudinal axis extending therethrough and including an inlet region 104 for admitting low pressure fuel into the pumping chamber and a discharge region 106 for discharging high pressure fuel from the pumping chamber.

A main drive shaft 132 extends through the interior chamber of pump housing 112 along the longitudinal axis thereof for driving a central shaft member 134. Shaft member 134 is supported for rotation by opposed journal bearings 136*a* and 136*b*, and is keyed to rotor member 116 for imparting rotational motion thereto. Rotor member 116 includes a plurality of radially extending slots 138, each for supporting a corresponding vane elements 118. The vane elements fit snugly within the slots and function like pistons as they are depressed radially inwardly during movement of the rotor member through the discharge arc of the pump. Each slot has an undervane cavity defining an area that is open to inlet pressure when the vane element is in the inlet arc region of the pump, and to discharge pressure when the vane element is in the discharge arc region of the pump.

Figure 5:
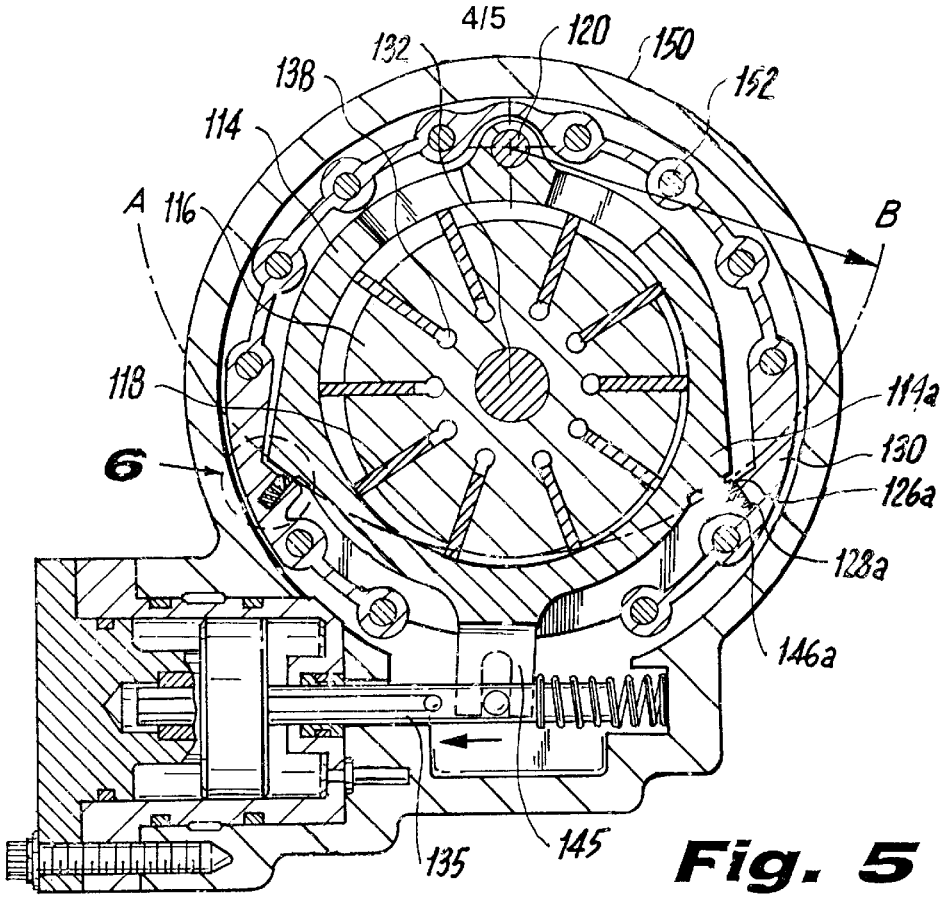
FIG. 5 is a cross-sectional view of the variable displacement vane pump of the subject invention, taken along line 5—5 of FIG. 4, wherein the cam seals are located at opposite ends of a chord of an arc through which the cam member swings, and the cam member is illustrated in a maximum stop position.
Figure 6:
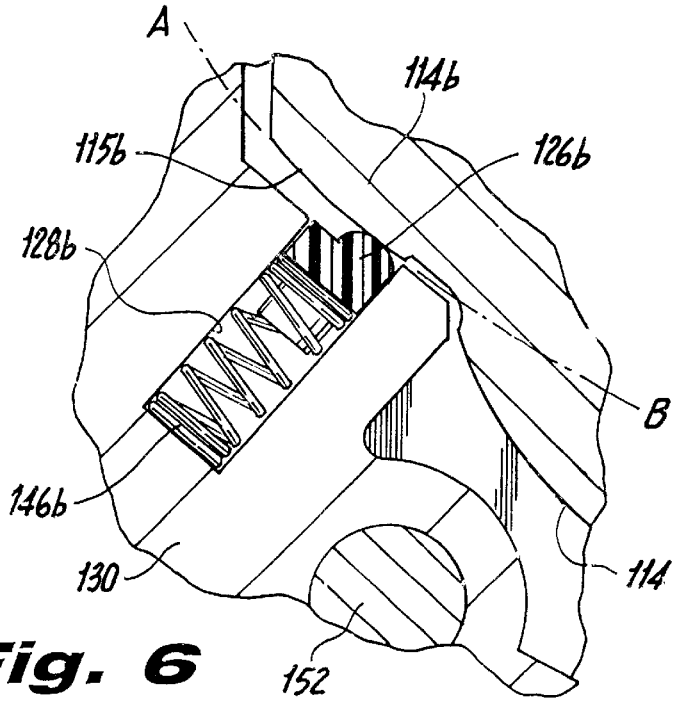
FIG. 6 is an enlarged localized view of a cam seal of the variable displacement vane pump illustrated in FIG. 5 when the cam member is disposed in a maximum stop position.
Figure 7:
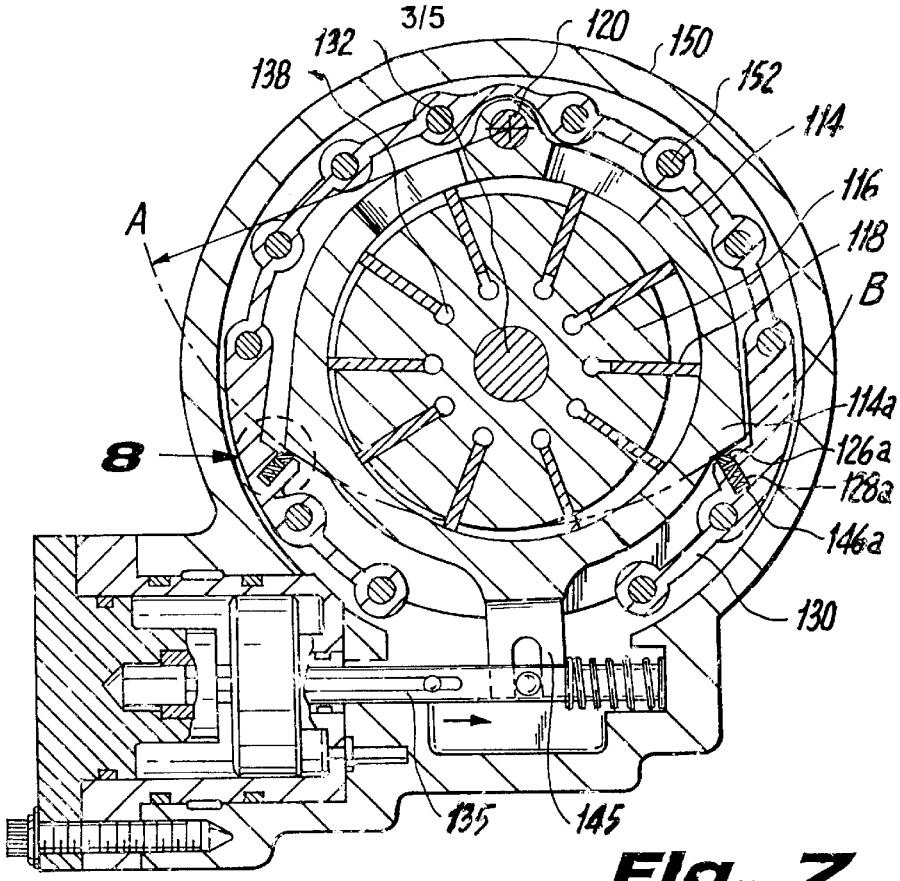
FIG. 7 is a cross-sectional view of the variable displacement vane pump of the subject invention, taken along line 5—5 of FIG. 4, wherein the cam member is illustrated in a minimum stop position.
Figure 8:
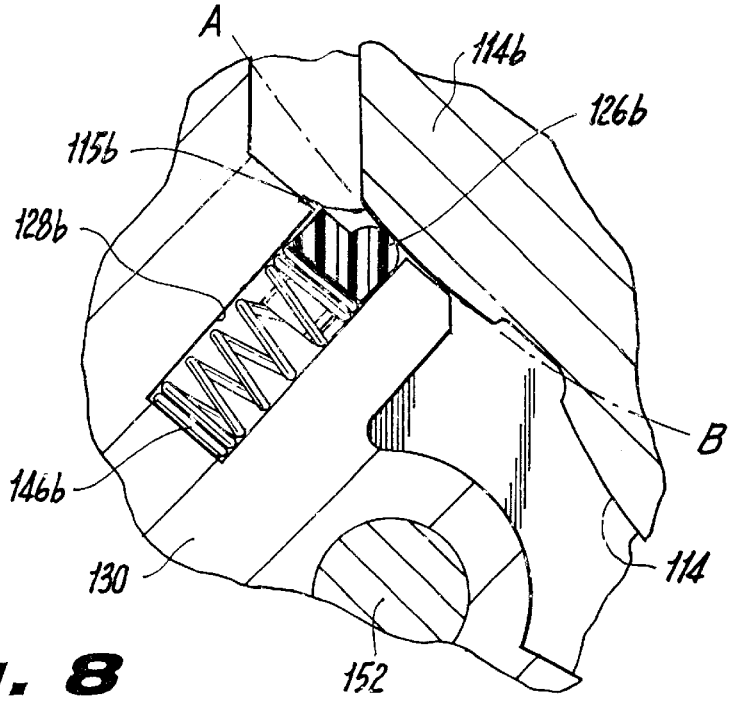
FIG. 8 is an enlarged localized view of the cam illustrated in FIG. 6 when the cam member is disposed in the minimum stop position.

A cam member 114 is mounted for pivotal movement within pump housing 112 about pivot pin 120 defining a fulcrum, to vary the displacement of vane pump 100. Cam member 114 includes a one-piece body that defines a circular bore 122 forming a cam chamber 125. Cam chamber 125 defines a smooth continuous annular cam surface 124 dimensioned and configured to make continuous contact with the outer tip surfaces of the plural vane elements 118 as rotor member 116 rotates about the axis of the pump housing 112. A lever 145 extends from the body of cam member 114 and is pivotably connected to an acuation piston 135 for varying the position of the cam member 114 relative to the rotor member 116. (See FIGS. 5 and 7).

Opposed sideplates 140 and 142 disposed within a cylindrical housing member 150 form a sealed cavity between cam member 114 and rotor member 116, and provide inlet and discharge ports for the cavity. An axial spacer 130 having a thickness that is slightly greater than the thickness of cam member 114 is disposed between sideplates 140 and 142. This allows the sideplates 140 and 142 to be tightly clamped against the spacer 130 by a plurality of threaded fasteners 152 while allowing small gaps to remain between the cam member 114 and the sideplates to reduce or eliminate friction therebetween.

As best seen in FIGS. 5 through 8, cam member 114 includes opposed radially outwardly extending sealing lands 114*a* and 114*b*. The sealing lands define arcuate cam surfaces 115*a* and 115*b*, respectively. Cam surfaces 115*a* and 115*b* are configured in such a manner so as to define arcuate segments of the cam arc A-B through which cam member 114 swings relative to rotor member 116.

Spring biased cam seals 126*a* and 126*b* are supported in slots 128*a* and 128*b*, respectively, formed in spacer 130 for controlling fluid leakage between the high pressure and lower pressure zones defined in the cavity formed between opposed sideplates 140 and 142. Cam seals 126*a* and 126*b* have intersecting axes that are radially aligned with the fulcrum of cam member 114, and are positioned at each end of a chord of the cam arc A-B. The chord extends parallel to and is located below the horizontal centerline of the interior chamber of pump housing 112. Those skilled in the art will readily appreciate that the relative distance between the chord of cam arc A-B and the horizontal centerline of pump housing 112, and hence the positions of cam seals 126*a* and 126*b*, can vary, so long as the cam surfaces 115*a* and 115*b* of cam member 114 coincide with cam arc A-B.

The cam seals 126*a* and 126*b* are adapted and configured to remain in continuous contact with the radially outer surface of cam member 114 at all times during operation under the bias of coiled springs 146*a* and 146*b*. More particularly, as the cam member 114 moves between the maximum stop position illustrated in FIGS. 5 and 6, and the minimum stop position illustrated in FIGS. 7 and 8, the cam seals remain in a static condition, biased into contact with the cam member 114 by springs 146*a* and 146*b*.

Thus, cam seals 126*a* and 126*b* function as static seals, in that they do not translate within slots 128*a* and 128 in response to pivotal movement of the cam member between the maximum and minimum stop positions. Consequently, the cam seals will not have a tendency to bind up in their slots during operation. This advantageously minimizes the risk of fuel leakage between the low pressure and high pressure zones of the pump.

Although the subject invention has been described with respect to a preferred embodiment, it should be readily apparent to those having ordinary skill in the art that modifications and changes may be made thereto without departing from the sprit or scope of the subject invention as defined by the appended claims.

What is claimed is:

1. A variable displacement vane pump comprising:

a) a pump housing having a cylindrical interior chamber defining a central axis through which a vertical centerline and a horizontal centerline extends;

b) a cylindrical rotor member mounted for rotational movement within the interior chamber of the pump housing about an axis aligned with the central axis of the interior chamber, the rotor member having a central vane section including a plurality of circumferentially spaced apart radial vane slots formed therein, each vane slot supporting a corresponding vane element mounted for radial movement therein, each vane element having an outer tip surface;

c) a cam member mounted for pivotal movement within the interior chamber of the pump housing about a fulcrum aligned with the vertical centerline of the interior chamber, the cam member defining a cam body having a circular bore extending therethrough for receiving the rotor member, the circular bore forming a cam chamber defining a cam surface making continuous contact with the outer tip surfaces of the vane elements during the rotation of the rotor member, the cam body having first and second lateral sealing lands formed thereon, the sealing lands being offset from the vertical centerline of the interior chamber and having arcuate sealing surfaces defining segments of a cam arc through which the cam member pivots relative to the rotor member; and d) means for adjusting the position of the cam member relative to the rotor member.

2. A variable displacement vane pump as recited in claim 1, further comprising lateral cam seals supported within the interior chamber of the pump housing and oriented on each end of a chord of the cam arc, each cam seal mounted for continuous contact with an adjacent sealing surface of the cam member.

3. A variable displacement vane pump as recited in claim 2, wherein the chord of the cam arc extends parallel to the horizontal centerline of the interior chamber.

4. A variable displacement vane pump as recited in claim 2, wherein the chord of the cam arc extends parallel to and is located below the horizontal centerline of the interior chamber.

5. A variable displacement vane pump as recited in claim 2, wherein the cam seals are biased into a contact position.

6. A variable displacement vane pump as recited in claim 2, wherein the cam seals are biased into a contact position by biasing springs.

7. A variable displacement vane pump as recited in claim 2, wherein the cam seals are supported by a spacer mounted between opposed sideplates.

8. A variable displacement vane pump as recited in claim 2, wherein each cam seal has an axis radially aligned with the fulcrum of the cam member.

9. A variable displacement vane pump comprising:

a) a pump housing having a cylindrical interior chamber defining a central axis through which a vertical centerline and a horizontal centerline extends;

b) a cylindrical rotor member mounted for rotational movement within the interior chamber of the pump housing about an axis aligned with the central axis of the interior chamber, the rotor member having a central vane section including a plurality of circumferentially spaced apart radial vane slots formed therein, each vane slot supporting a corresponding vane element mounted for radial movement therein, each vane element having an outer tip surface;

c) a cam member mounted for pivotal movement within the interior chamber of the pump housing about a fulcrum aligned with the vertical centerline of the interior chamber, the cam member defining a cam body having a circular bore extending therethrough for receiving the rotor member, the circular bore forming a cam chamber defining a continuous cam surface making contact with the outer tip surfaces of the vane elements during the rotation of the rotor member, the cam body having lateral sealing lands formed thereon, the sealing lands having arcuate sealing surfaces defining segments of a cam arc through which the cam member pivots about the fulcrum relative to the rotor member; and d) static cam seals supported within the interior chamber of the pump housing and oriented offset from the vertical centerline of the interior chamber, on each end of a chord of the cam arc, each cam seal biased into a continuous contact position with an adjacent sealing surface of the cam member.

10. A variable displacement vane pump as recited in claim 9, wherein the chord of the cam arc extends parallel to the horizontal centerline of the interior chamber.

11. A variable displacement vane pump as recited in claim 9, wherein the chord of the cam arc extends parallel to and is located below the horizontal centerline of the interior chamber.

12. A variable displacement vane pump as recited in claim 9, wherein the static cam seals are biased into a contact position by biasing springs.

13. A variable displacement vane pump as recited in claim 9, wherein the static cam seals are supported by a spacer mounted between opposed sideplates.

14. A variable displacement vane pump as recited in claim 9, wherein each static cam seal has an axis radially aligned with the fulcrum of the cam member.

15. A variable displacement vane pump as recited in claim 9, further comprising means for adjusting the position of the cam member relative to the rotor member.

16. A variable displacement vane pump comprising:

a) a pump housing having a cylindrical interior chamber defining a central axis through which a vertical centerline and a horizontal centerline extends;

b) a cylindrical rotor member mounted for rotational movement within the interior chamber of the pump housing about an axis aligned with the central axis of the interior chamber c) a cam member mounted for pivotal movement within the interior chamber of the pump housing about a fulcrum aligned with the vertical centerline of the interior chamber, the cam member defining a cam body having a circular bore extending therethrough for receiving the rotor member, the cam body having lateral sealing lands formed thereon, the sealing lands having arcuate sealing surfaces defining segments of a cam arc through which the cam member pivots about the fulcrum relative to the rotor member;

d) opposed sideplates disposed within the interior chamber of the pump housing and supporting the rotor member and cam member therebetween;

e) an axial spacer having an axial thickness slightly greater than an axial thickness of the cam member and positioned between the opposed sideplates for reducing friction between the sideplates and the cam member; and f) static cam seals supported by the axial spacer and oriented offset from the vertical centerline of the interior chamber, on each end of a chord of the cam arc, each cam seal biased into a continuous contact position with an adjacent sealing surface of the cam member.

17. A variable displacement vane pump as recited in claim 16, wherein the rotor member has a central vane section including a plurality of circumferentially spaced apart radial vane slots formed therein, and each vane slot supports a corresponding vane element mounted for radial movement therein, and each vane element has an outer tip surface.

18. A variable displacement vane pump as recited in claim 17, wherein the circular bore of the cam member forms a cam chamber defining a continuous cam surface making contact with the outer tip surfaces of the vane elements during the rotation of the rotor member.

19. A variable displacement vane pump as recited in claim 16, further comprising means for adjusting the position of the cam member relative to the rotor member.

* * * * *